US011920893B1

(12) United States Patent
Johnson

(10) Patent No.: US 11,920,893 B1
(45) Date of Patent: Mar. 5, 2024

(54) SLING MOUNT FOR LEVER ACTION FIREARM

(71) Applicant: Daniel Johnson, Selkirk, NY (US)

(72) Inventor: Daniel Johnson, Selkirk, NY (US)

( * ) Notice: Subject to any disclaimer, the term of this patent is extended or adjusted under 35 U.S.C. 154(b) by 0 days.

(21) Appl. No.: 17/902,958

(22) Filed: Sep. 5, 2022

(51) Int. Cl.
*F41C 33/00* (2006.01)

(52) U.S. Cl.
CPC ..... *F41C 33/002* (2013.01)

(58) Field of Classification Search
CPC ..... F41C 33/001; F41C 33/002; F41C 33/007
See application file for complete search history.

(56) References Cited

U.S. PATENT DOCUMENTS 2,296,733 A 9/1942 Paolino 4,505,012 A * 3/1985 Johnson ..... F41C 23/02 24/643

5,810,219 A 9/1998 Rosenfield

* cited by examiner

*Primary Examiner* — Corey N Skurdal
(74) *Attorney, Agent, or Firm* — Sanchelima & Associates, P.A.; Christian Sanchelima; Jesus Sanchelima

(57) ABSTRACT

A sling mount for lever action firearm including a sling member which can be adapted to a lever action rifle member by a cocking arm. The sling member includes an attaching portion which is placed within the sling member to be adjusted to the cocking arm. The sling member includes apertures along a body thereof wherein two apertures enclose the attaching portion and another of the apertures passes through the sling member by a distal end thereof. The sling member is secured by a locking member which includes apertures configured to be concentrical with two apertures of the attaching member and a pair of fasteners passing through the apertures. A strap member includes a hook which can be adjusted to an aperture of the sling member and another distal end can be attached to another portion of a lever action rifle member thereby holding thereof by a user.

2 Claims, 4 Drawing Sheets

SLING MOUNT FOR LEVER ACTION FIREARM

BACKGROUND OF THE INVENTION

The present invention relates to a sling mount for lever action firearm and, more particularly, to a sling mount for lever action firearm that clips or secures to a lever of the action firearm and by one end and another end is clipped either a barrel or butt of a gun.

DESCRIPTION OF THE RELATED ART

Several designs for sling mount for lever actions have been designed in the past. None of them, however, include a sling mount which clips on a lever and a barrel of a gun by distal ends.

Applicant believes that a related reference corresponds to U.S. Pat. No. 5,810,219 issued for a detachable sling mount for a rifle. Applicant believes that another related reference corresponds to U.S. Pat. No. 2,296,733 issued for a riffle attached carrying strap or sling apparatus. None of these references, however, teach of a sling mount for a lever action rifle wherein one end of the sling is clipped or secured to the lever and one end clipped either to the barrel or the butt of the gun.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a sling mount for lever action firearm which secures to a lever thereof by a sling member It is another object of this invention to provide a sling mount for lever action firearm that clamps the lever of a lever firearm.

It is still another object of the present invention to provide a sling mount for lever action firearm with fasteners that secure said sling when mounted on the lever of a firearm.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
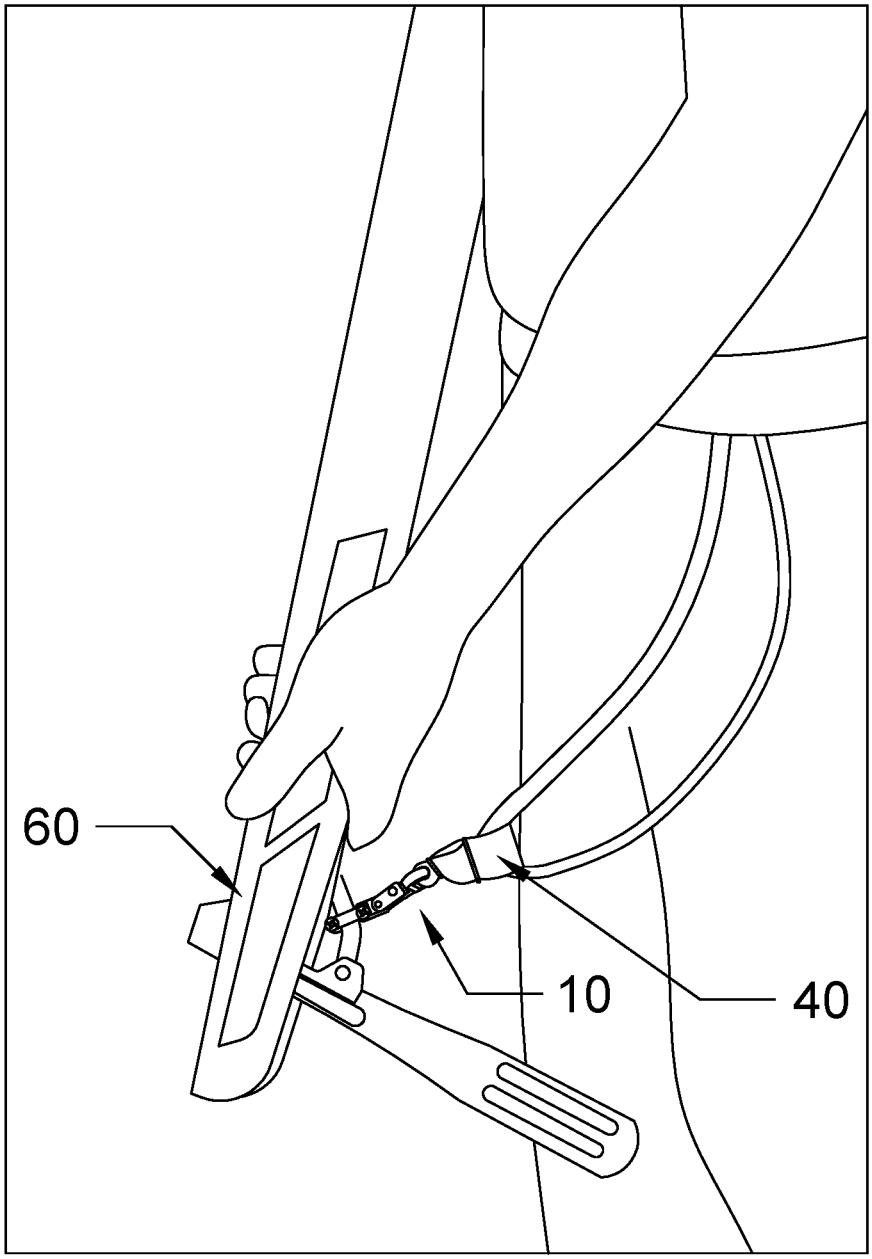
FIG. 1 represents an operational view of the present invention 10 wherein a user is holding a lever action rifle assembly 60 by a strap assembly 40.

Referring now to the drawings, where the present invention is generally referred to with numeral 10, it can be observed that it basically includes a sling assembly 20, a strap assembly 40 and a lever action rifle assembly 60. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Figure 2:
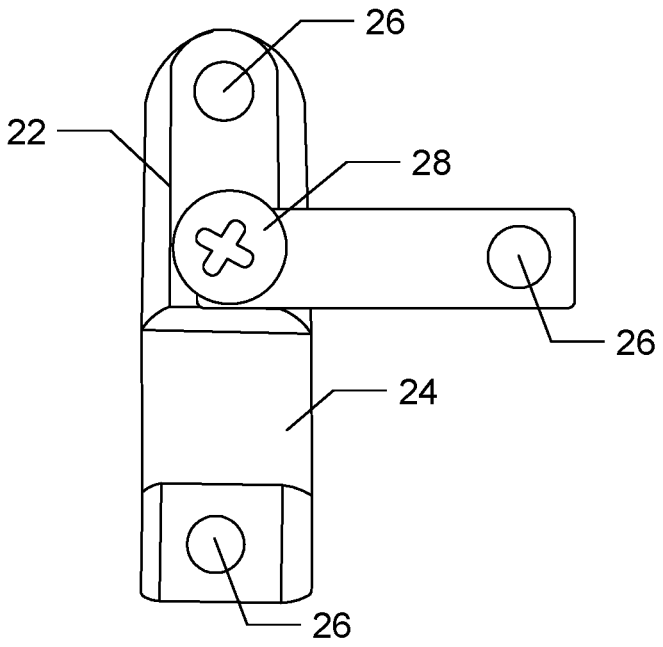
FIG. 2 shows a top isometric view of a sling member 22 with a lock member 22*a* and apertures 26.

The sling assembly 20 includes a sling member 22, a locking member 22*a*, an attaching portion 24, apertures 26 and fasteners 28. The sling member 22 is configured to be attached to the lever action rifle assembly 60 by the strap assembly 40. In a suitable embodiment, the sling member 22 may be made of a steel material to withstand constant force applied thereof by the strap assembly 40. Nevertheless, in other embodiments, materials like metal, stainless steel or any other alloy thereof may be suitable for the sling member 22 to have a resistance when holding the lever action rifle assembly 60 by the strap assembly 40. The sling member 22 in a suitable embodiment may have a rectangular body with rounded sides as best shown in FIG. 2. Nevertheless, other shapes for the sling member 22 may be suitable considering the dimension when attached to the lever action rifle assembly 60. It should be considered that the sling member 22 may conform with a portion of the lever action rifle assembly thereby adjusting thereof. In one embodiment, the sling member 22 may be placed adjacent with the locking member 22*a* by a surface thereof as best observed in FIG. 2 the locking member 22*a* may be adjacent to the sling member 22 and may be connected by at least one of the fasteners 28 wherein the locking member 22*a* and the sling member 22 may include apertures 26 which are concentrically placed both of each when inserting one of the fasteners 28 therethrough.

Figure 2A:
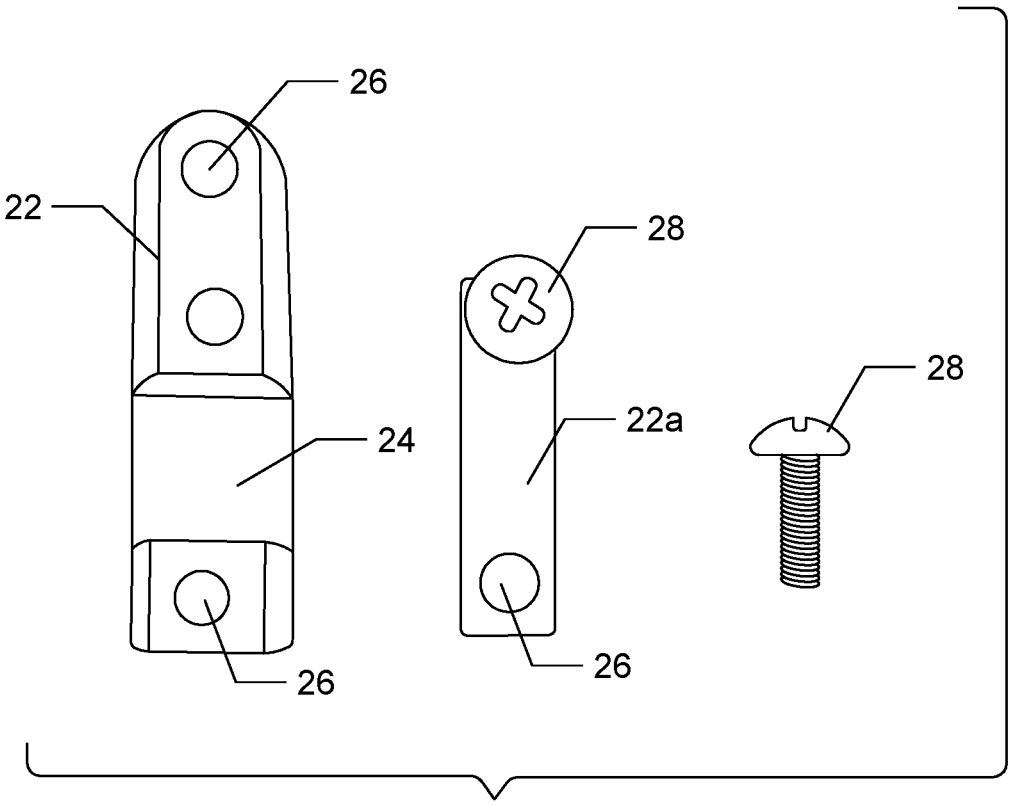
FIG. 2*a* shows an exploded view of a sling member 22 with an attaching portion 24 and fasteners 28.

As best shown in FIG. 2A, the sling member 22 may include the apertures 28 which pass through along the body thereof, wherein one of the apertures 26 are placed on a bottom portion of the attaching portion 24 and another of the apertures 26 is placed on a top portion of the attaching portion 24, one of the apertures 26 is placed on a top portion along the surface of the sling member 22. It may be understood that the apertures 26 may entirely pass through the body of the sling member 22 wherein each of the apertures 26 may be configured to seal the sling member 22 by the locking member 22*a* which adjust adjacent to above the attaching portion 24 and each of the apertures 26 placed on each distal end of the locking member 22*a* are concentrically placed relative the apertures 26 placed proximal to the attaching portion 24 as best observed in FIG. 2/FIG. 2A. It may be considered that the attaching portion 24, the locking member 22*a* the apertures 26 and the fasteners 28 may be made of a carbon steel material. Nevertheless, other steel alloys may be suitable for the attaching portion 24, the locking member 22*a* the apertures 26 and the fasteners 28. In a suitable embodiment, the attaching portion 24 may have a rectangular hollow shape further configured to be attached to the lever action rifle assembly 60. In a preferred embodiment, the locking member 22*a* may have a shape that conforms with the surface of the sling member 22 wherein the attaching portion 24 is placed allowing to set the locking member 22*a* by at least one of the fasteners 28 as best observed in attaching portion 24, the locking member 22*a*, the apertures 26 and the fasteners 28 as best observed in FIG. 2.

The strap assembly 40 includes a strap member 42 and hooks 44. In a preferred embodiment, the strap member 42 may be made of polyester. Nevertheless, other materials like polypropylene or steel strap may be suitable for the strap member 62. The strap member 62 may be configured to attach to the sling member 22 as best observed in FIG. 1 wherein a user is holding the lever action rifle assembly 60 by the strap assembly 40. It is to be understood that the strap member 42 may be attached from a hook 44 by a distal end thereof to the sling member 22. It is also to be considered that the strap member 42 may be attached to a rear side of the lever action rifle assembly 60 as known in the art to cooperate holding the lever action rifle assembly 60 with the sling member 22. Ina preferred embodiment the strap member 42 may have an elongated rectangular shape as best observed in FIG. 1. Nevertheless, strap may be customized by the user, the strap member 42 may include the hook 44 which attach to at least one of the apertures 26 placed on a distal end of the sling member 22 as best observed in FIG. 3 and FIG. 4. The hook 44 may be suitable to conform with at least one of the apertures 26 placed on the sling allowing to secure the strap member 42 to the sling member 22 thereby holding the lever action rifle assembly 60. In a preferred embodiment, the hook 44 may be of a steel material to withstand the tension applied to thereof when holding the lever action rifle assembly 62.

Figure 3:
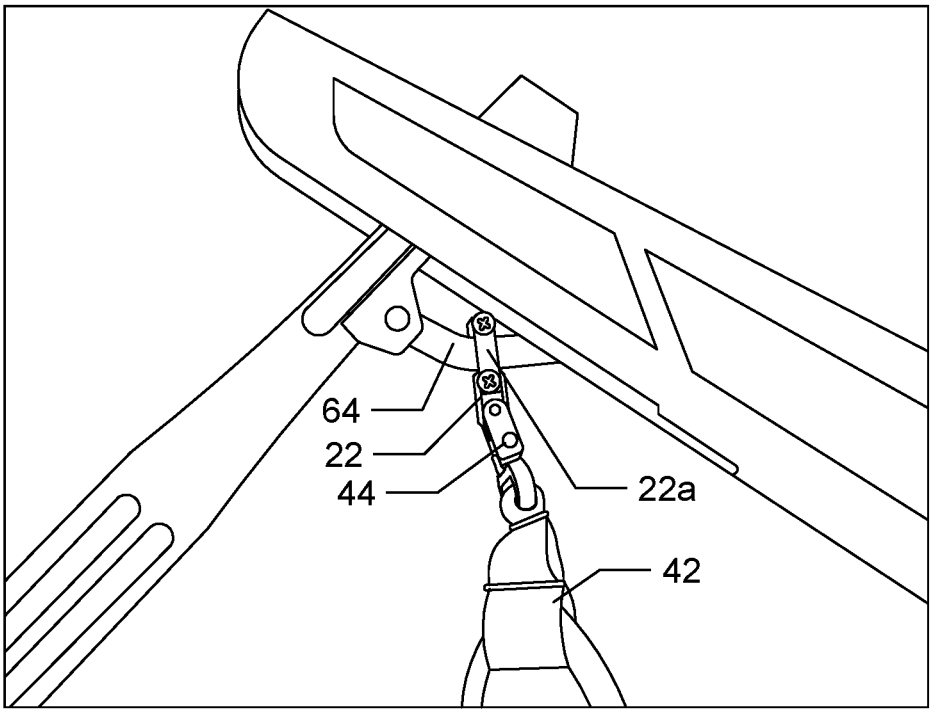
FIG. 3 illustrates a front isometric view of the sling 22 secured to a cocking arm 44 by the lock member 22*a* in cooperation with the fasteners 28.
Figure 4:
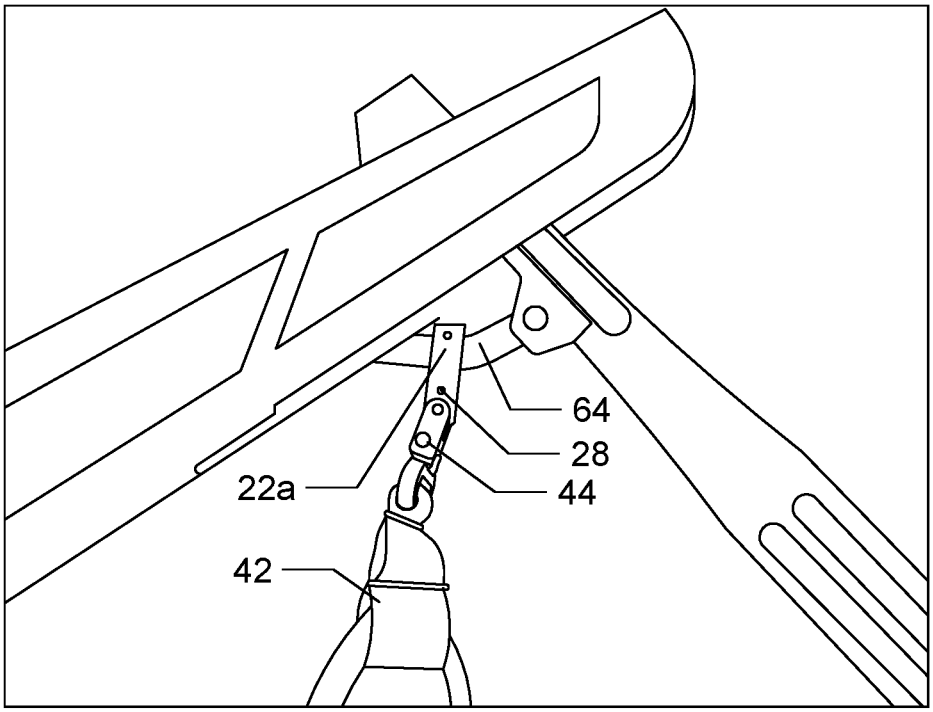
FIG. 4 is a representation of a rear isometric view of the sling 22 being secured to the cocking arm 64 by fasteners 28.
Figure 5:
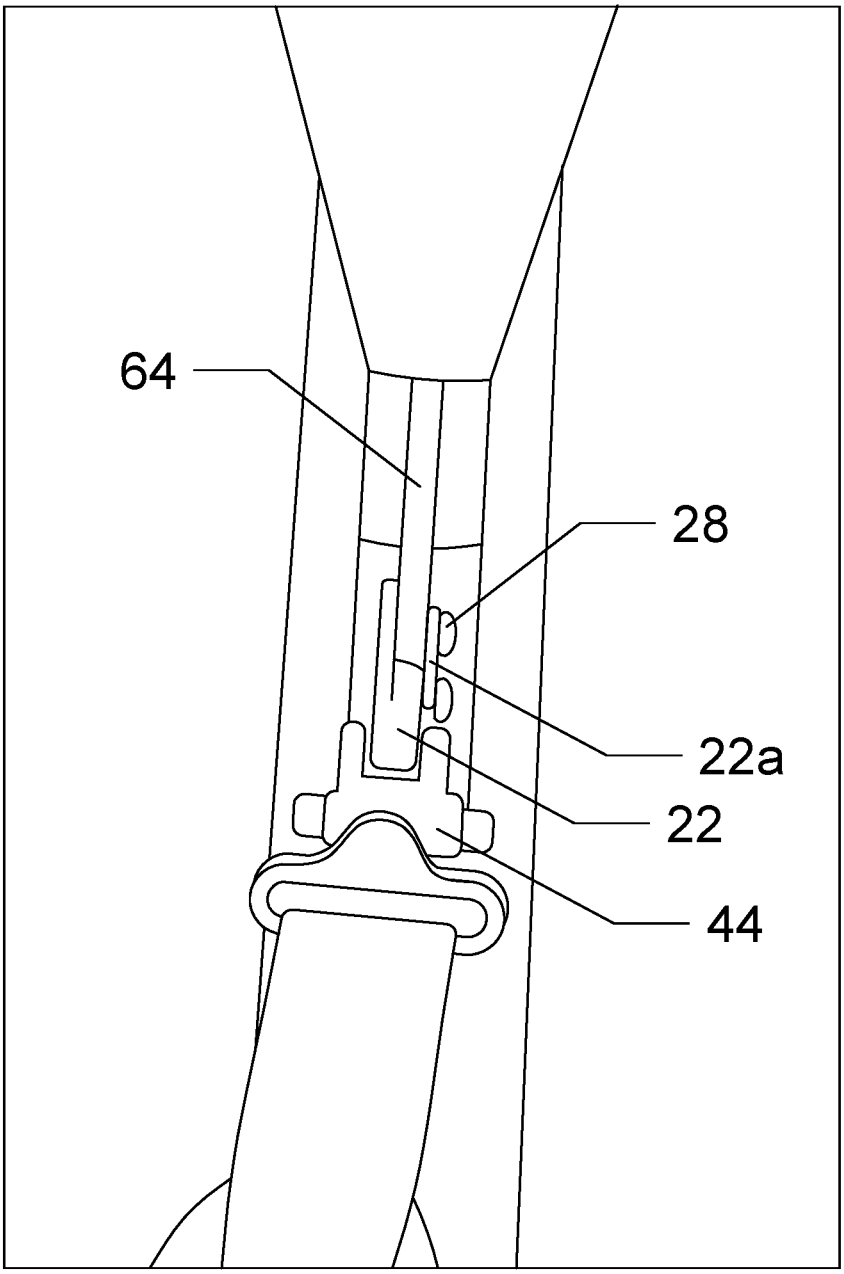
FIG. 5 is a rear view of a hook 44 mounted to the cocking arm 64 by the sling member 22.

The lever action rifle assembly 60 includes a lever action rifle member 62 and a cocking arm 64. It is to be considered that the lever action rifle member 62 may be any type of gun considering the cocking arm 64 may be attached to the gun. In a preferred embodiment, the lever action rifle member 62 may be suitable to receive the strap member 42 by one distal end thereof and the sling member 22. The lever action rifle member 62 may be configured to be held by the user when adjusting the sling member 22 to the cocking arm 64 as best shown in FIG. 3, FIG. 4 and FIG. 5 wherein the sling member 22 may be attached to the cocking arm 64 by the attaching portion 24 allowing a surface of the sling member 22 to be coplanar relative to a surface of the cocking arm 64, at least two of the fasteners 28 may pass through at least two of the apertures 26 thereby securing the sling member 22 to the cocking arm 64.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A sling mount for a lever action firearm, comprising:

a sling assembly including a sling member which has a rectangular shape with rounded edges, said sling member includes an attaching portion placed on an inner body thereof, said attaching portion having a hollow rectangular body which further conforms with a cocking arm, said attaching portion is secured by a locking member which have a rectangular body placed above said attaching portion, said sling member includes apertures along a body thereof, wherein at least two of said apertures are located on opposite sides of the attaching portion, said sling member is attached to said cocking arm by said attaching portion which is adjacent to a surface of said cocking arm, said sling member is secured by fasteners which pass through openings of said locking member are placed above said attaching portion, said openings from said locking member are concentrically placed with said apertures from said attaching portion, said sling member having an aperture on a distal end thereof;

a strap assembly including a strap member configured to be attached to said sling member by a clasp, said clasp is placed on a distal end of said aperture on the distal end of the lever action rifle, said strap member is secured to said lever action rifle by means of the sling member at one end and can be secured to a distal end of the rifle by a second end of the strap member; and the lever action rifle including a lever action rifle member with said cocking arm being secured by said sling member by said locking member, said cocking arm having a rectangular elongated body which conforms with said attaching portion when inserting said sling member thereof, said cocking arm being coplanar with said sling member when secured by said locking member.

2. A sling mount fora lever action firearm, consisting of:

a sling assembly including a sling member which has a rectangular shape with rounded edges, said sling member includes an attaching portion placed on an inner body thereof being exposed and configured to receive a rectangular shape, said attaching portion having a hollow rectangular body which further conforms with a cocking arm, said attaching portion is secured by a locking member which have a rectangular body placed above said attaching portion, said sling member includes apertures along a body thereof wherein at least two of said apertures are located on opposite sides of the attaching portion, said sling member is attached to said cocking arm by said attaching portion which is adjacent to a surface of said cocking arm, said locking member is placed above said attaching portion and secured by fasteners which pass through said apertures of said locking member, wherein said locking member includes apertures concentrically placed with said apertures from said attaching portion when setting said locking member above said attaching portion, said sling member having an aperture on a distal end thereof configured to insert a cylindrical shape;

a strap assembly including a strap member configured to be attached to said sling member by a clasp with a cylindrical shape, said clasp is placed on a distal end of said aperture on the distal end of the lever action rifle, said strap member is secured to said lever action rifle by means of the sling member at one end and can be secured to a distal end of the rifle by a second end of the strap member; and the lever action rifle including a lever action rifle member with said cocking arm being secured by said sling member by said locking member, said cocking arm having a rectangular elongated body which conforms with said attaching portion when inserting said sling member thereof, said cocking arm being coplanar with said sling member when secured by said locking member.

* * * * *